United States Patent [19]

Malott

[11] 4,268,220

[45] May 19, 1981

[54] THRUST BALANCING

[75] Inventor: Richard C. Malott, Indianapolis, Ind.

[73] Assignee: General Motors Corporation, Detroit, Mich.

[21] Appl. No.: 17,608

[22] Filed: Mar. 5, 1979

[51] Int. Cl.[3] ..... F01D 3/04

[52] U.S. Cl. ..... 415/104; 60/39.31; 308/160

[58] Field of Search ..... 415/104, 175, 105, 107; 60/39.31; 308/160, 176

[56] References Cited

U.S. PATENT DOCUMENTS

| | | | |
|---|---|---|---|
| 2,779,531 | 1/1957 | Wheatley | 415/104 X |
| 3,468,259 | 9/1969 | Morzynski et al. | 415/175 |
| 3,485,541 | 12/1969 | Sandy, Jr. | 308/160 |
| 3,491,536 | 1/1970 | Hadaway | 60/39.31 |
| 3,505,813 | 4/1970 | McCarthy | 60/39.31 |
| 3,671,137 | 6/1972 | Ball | 415/104 |
| 3,746,461 | 7/1973 | Yokota et al. | 415/104 |
| 4,183,713 | 1/1980 | Erickson et al. | 415/104 X |

FOREIGN PATENT DOCUMENTS

| | | | |
|---|---|---|---|
| 851065 | 9/1939 | France | 415/104 |

*Primary Examiner*—Stanley N. Gilreath
*Attorney, Agent, or Firm*—J. C. Evans

[57] ABSTRACT

A gas turbine engine having variable geometry flow controllers therein for controlling mass flow in accordance with engine operation includes a rotor with a wide variation in thrust forces thereon during different phases of engine operation countered by a variable axial load integrating device having a rotating hydraulic thrust compensating piston mounted forwardly of the rotor in association with a rotor thrust bearing and further including means for generating a centrifugal head in accordance with engine speed and wherein improved oil distribution panels are included to evenly distribute oil between the rotating piston and a nonrotating counterpiston to form a uniform depth of rotating oil automatically regulated by an integral, flow regulator having flow area therethrough varied in accordance with axial position of a thrust bearing carriage that has the variable rotor thrust loading imposed thereon.

2 Claims, 2 Drawing Figures

THRUST BALANCING

Figure 1:
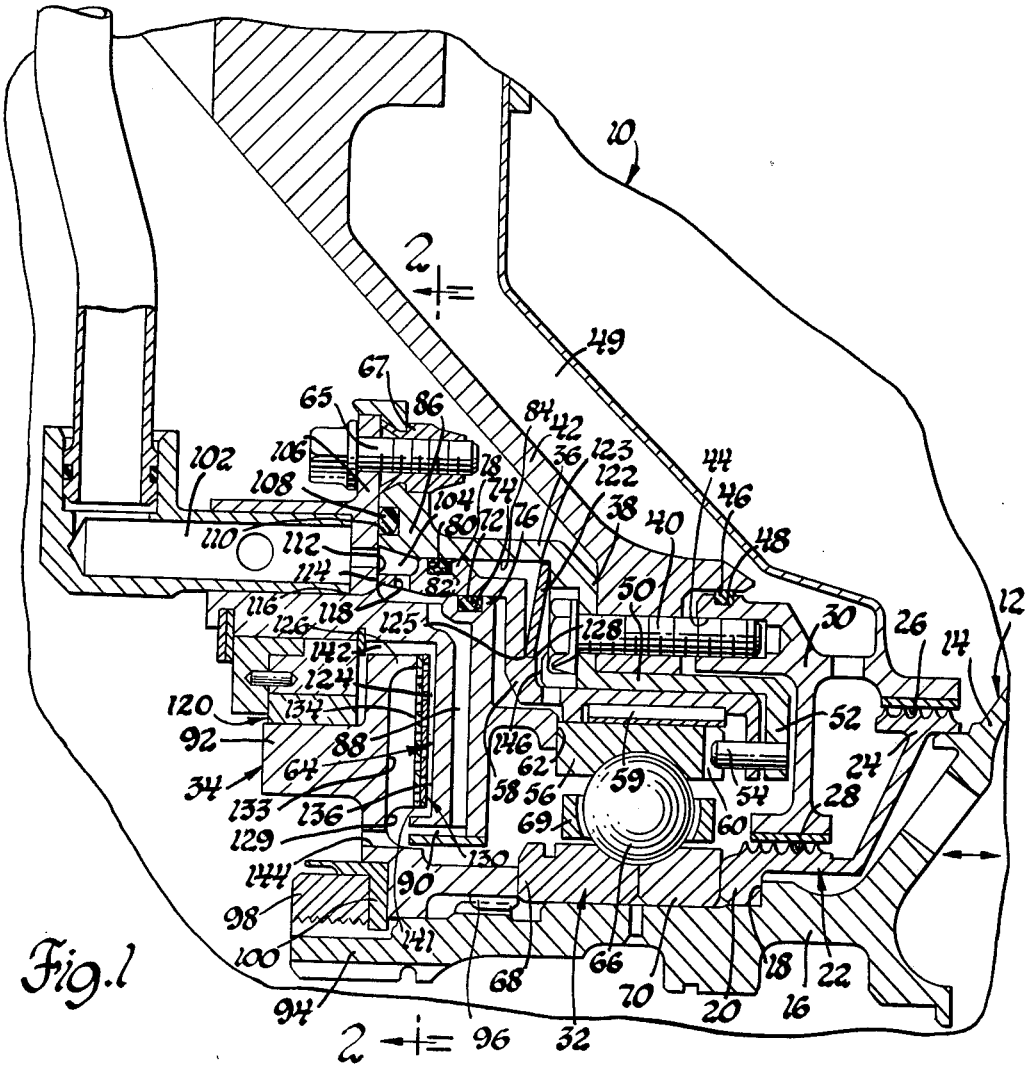

The invention herein described was made in the course of work under a contract or subcontract thereunder with the Department of Defense.

This invention relates to gas turbine engines and more particularly to means for compensating for variable thrust produced upon a rotor of a gas turbine engine.

Various proposals have been suggested for producing a hydraulic pressure differential upon bearing components so as to adjust axial thrust acting thereacross. For example, in U.S. Pat. No. 3,485,541, issued Dec. 23, 1969, to Sandy Jr., a balancer disc on a drive shaft has hydraulic pressure differentials produced thereacross so as to control the axial position of an associated shaft.

Another approach to balancing thrust in a rotary machine is set forth in the U.S. Pat. No. 3,505,813, issued Apr. 14, 1970, to McCarthy, wherein compressed gases are directed against a component to maintain a shaft in a substantially constant axial position relative to fixed structure of the engine, thereby to maintain a resultant axial load on a rotor thrust bearing substantially constant.

U.S. Pat. No. 3,468,259, issued Sept. 23, 1969, to Morzynski et al, includes an axial relieving arrangement for impeller type pumps wherein a spring bias thrust bearing is balanced by means of fluid in pressure balanced cavities having oil pressure directed therethrough and controlled to maintain a balanced load condition on the thrust bearing of the assembly.

U.S. Pat. No. 3,491,536, issued Jan. 27, 1970, to Hadaway, shows a gas turbine shaft bearing assembly having plurality of spring washers located therein producing opposed preloading spring forces for maintaining components of thrust bearings in a rotor assembly support constantly under load contact so as to avoid excessive vibration therebetween.

While the aforedescribed shaft positioning and/or thrust bearing load balance systems are suitable for their intended purpose, it is desirable to maintain a maximized thrust-to-weight ratio over the total operating range. It is necessary therefore to use the lightest weight thrust balance device possible including static supports for bearing assemblies and bearing assemblies themselves as well as the weight construction of associated thrust load compensating devices. Such devices are set forth in copending U.S. Ser. No. 840,267, to Douglas K. Thompson for Thrust Balancing Assembly with an assignee common to that in the present case.

An object of the present invention is to improve variable gas turbine rotor thrust loading devices mounted closely adjacent a rotor thrust bearing and wherein a thrust compensation force is generated by means of a centrifugal head by engine oil trapped in a cavity between relatively rotating pistons mounted on the rotor shaft and bearing support structure respectively, by the provision of means on one of pistons to evenly distribute into the cavity to produce a uniform hydraulic bridge automatically regulated oil flow between the pistons for generating an improved thrust balancing reaction therebetween.

Still another object of the present invention is to provide an improved rotor thrust balance device including a variable axial load integrating device with a pair of relatively rotating pistons mounted on a rotor shaft and to a bearing support structure respectively and including an oil pressure supply for producing a depth of centrifuged oil in an oil cavity between the relatively rotating pistons under control of a flow regulator having an area therethrough varied in accordance with bearing carriage position to produce a centrifugal head by the oil trapped between the relatively rotating pistons and a resultant thrust compensation rotor force and wherein the oil pressure supply includes means on one of the pistons for distributing oil uniformly to all parts of the oil cavity to assure complete oil fill across an axial gap between the pistons whereby a solid hydraulic axial bridge will form between the pistons to produce the centrifugal head.

Still another object of the present invention is to improve a gas turbine engine thrust bearing having rotor thrust forces directed thereagainst that vary from a thrust in a rearward direction during a first engine operating mode and in a forward direction under a second operating mode by provision of a variable axial load integrating device including a pair of relatively rotating pistons connected respectively to the engine drive shaft and to a fixed bearing support component and include means for directing oil therebetween and means including a perforated oil distribution cover on the rotating piston to cause oil to be uniformly trapped between a rotating one of the pair of pistons and a non-rotating counterpiston thereof to rotate with the rotor to develop a dynamic head that will counter swing rotor thrust levels so as to keep bearing load unidirectional and within a reduced range under all anticipated operating conditions.

Further objects and advantages of the present invention will be apparent from the following description, reference being had to the accompanying drawings wherein a preferred embodiment of the present invention is clearly shown.

Figure 2:
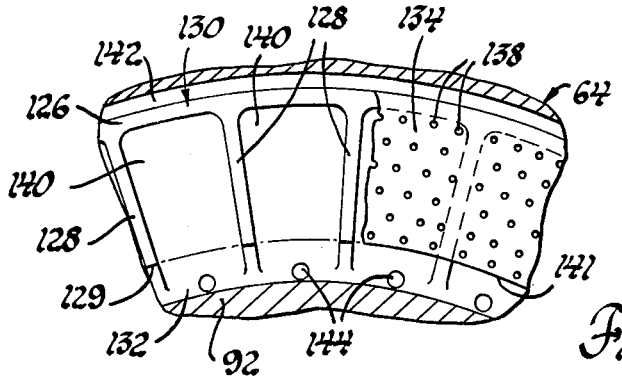

FIG. 1 is a fragmentary longitudinal sectional view of a gas turbine engine thrust balancer of the present invention; and FIG. 2 is a fragmentary sectional view taken along line 2—2 of FIG. 1 and looking in the direction of the arrows.

Referring now more specifically to FIG. 1 of the drawings, a fragmentary section is shown of a gas turbine engine of the variable geometry engine type with bypass fan that includes large swings in rotor thrust forces. More particularly, the engine 10 includes a high pressure compressor rotor 12, a portion of which is shown in FIG. 1. It includes a generally upwardly directed shaft segment 14 that is connected to an axially directed shaft segment 16. The shaft segment 16 includes an annular outer peripheral shoulder 18 thereon that supports one end 20 of an annular labyrinth seal assembly 22 having an opposite end 24 thereon. The ends 20, 24 of the labyrinth seal assembly 22 are located in rotating sealing relationship with a first annular seal surface 26 and a second annular seal surface 28 axially spaced and radially inwardly located from surface 26 and formed on a fixed seal support member 30 within the engine 10. A thrust bearing assembly 32 is located between the shaft segment 16 and a variable axial load integrating device 34 constructed in accordance with certain principles of the present invention.

It has been found that in advanced variable geometry engines that large swings in rotor thrust balance forces can occur on the rotor 12. For example, in one type of variable geometry gas turbine engine rotor thrust acting on the rotor 12. The variable axial load integrating device 34 is of light weight and readily associated with existing thrust bearing assemblies 32 to reduce bearing load at high rotor thrust loads.

More particularly, the device 34 includes an outer housing 36 with a flange 38 thereon connected by means of threaded bolts 40 one of which is illustrated in FIG. 1. The bolt 40 secures flange 38 and the seal support member 30 to a support structure 42. The end of each bolt 40 is received within a tapped hole 44 in the seal support member 30. An annular O-ring seal 46 is contained within an annular groove 48 in the seal support 30 to prevent the leakage of bearing lubricating oil into the air passage 49.

The flange 38 includes a tubular extension 50 with a small inward projecting tang 52 into which is secured a pin 54 which prevents circumferential rotation of the bearing outer race 56 and an axially movable bearing carriage 58. The outer race 56 is biased radially by leaf springs 59 which are trapped between the outer race 56 and the bearing carriage 58. The bearing outer race 56 has a radial slot 60 which engages the pin 54 to prevent race rotation. Further, the outer race 56 is axially contained within the bearing carriage 58 by means of an abutment 62 on a counterpiston 64 while it is fixed to fixed housing 36 by threaded bolts 65 and nuts 67.

The thrust bearing assembly 32 includes a plurality of ball elements 66 located at circumferentially spaced points as established by a ball retainer 69. Additionally, the thrust bearing assembly 32 includes a pair of inner races 68, 70. The inner race 70 engages the end 20 of the labyrinth seal assembly 22 and is carried by the rotor 12 to transfer operational thrust loads from the rotor 12 into the thrust bearing assembly 32. Rotor 12, thrust bearing 32 and carriage 58 move as a unit a limited axial extent in the order of 0.010 inches. Carriage 58 is sealed with respect to piston 64 by an O-ring seal 72 in a groove 74 in an annular, inboard periphery 76 of piston 64. The variable axial load integrating device 34 and its carriage 58 has an outboard segment 78 thereon with a groove 80 carrying a peripheral O-ring seal 82 that slidably sealingly engages a bore 84 in an extension 86 of outer housing 36.

The counterpiston 64 includes an oil supply passage 88 with an outlet 90 facing a rotating piston 92 secured against rotation on a rotor shaft end 94 by means of a splined coupling 96. The rotating piston 92 is held in place on a shaft end 94 by means of a retainer nut 98 and a lock washer 100.

Oil at engine oil pressure is supplied by an inlet tube 102 into an inlet cavity 104 formed between an outer peripheral flange 106 on the non-rotating counterpiston 64. Cavity 104 is sealed with respect to the housing extension 86 by O-ring seal 108 supported in an outboard peripheral groove 110 in the housing 86. Oil flow from the inlet cavity 104 is across opposed flow regulating surfaces 112, 114 formed respectively on the flange 106 and a tip 116 of the outboard segment 78 of axially movable bearing carriage 58 and operable to define a flow regulating gap therebetween. The bearing carriage segment 78 further includes a bypass opening 118 that will supply a limited amount of oil to lubricate a seal assembly 120 between the counterpiston 64 and the rotating piston 92 during operation with the flow regulating surfaces 112, 114 closed. Oil from the inlet cavity 104 is directed to the passage 88 thence to the outlet 90.

In the aforesaid system, during engine start-up, the bearing carriage 58 is pushed toward the left as shown in FIG. 1 by a Belleville spring 122 that includes a radially outer edge 123 seated against the housing 36 and a radially inner edge 125 biased against an external shoulder of the carriage 58. The Belleville spring 122 has a preload to cause the facing surfaces 112, 114 of the flow regulator to be closed. Oil flow from the inlet tube 102 is thereby limited to flow across the bypass opening 118 so that during start-up or conditions where less than the pre-thrust load occurs on the rotor 12, oil flows only in sufficient quantity to lubricate the bushing type seal assembly 120.

During engine operation to produce an intermediate rotor thrust load greater than the pre-thrust load in a direction to the right on the rotor as viewed in FIG. 1, the force of the Belleville spring 122, which acts to the left as shown in FIG. 1, will be overcome. Accordingly, the bearing carriage 58 will move to the right as shown in FIG. 1 and thereby open to define an annular flow regulating gap between opposed surfaces 112, 114. Oil will flow inwardly through this regulating gap, thence through the passage 88 and the outlet 90.

In accordance with certain principles of the present invention the rotating piston 92 includes an oil balance system 130 thereon that serves to uniformly distribute oil from the outlet 90 into a cavity 124 formed between the relatively rotating piston 92 and counterpiston 64. More particularly, the oil distributing system 130 includes an inwardly facing axial flange 126 thereon formed circumferentially around the outer periphery of the rotating piston 92. It includes a plurality of circumferentially spaced radially inwardly directed reinforcing ribs 128 integrally formed therewith, each including free end portions 129 thereon in the form of a fillet that forms a transition from a curved annular, radially inwardly located surface 132 of the inboard face 133 of the rotating piston 92 that is in alignment with the outlet 90 as best seen in FIG. 1. .

Each of the ribs 128 serve to maintain an annular laminated plate cover 134 on the inboard side of the piston 92 in spaced parallel relationship to a flat parallel outboard facing surface 136 on counterpiston 64. The cover 134 is preferably formed of multi plates of controlled porosity of the type set forth in U.S. Pat. No. 3,584,972, issued June 15, 1971, to Bratkovich et al. Such laminated plates have a plurality of offset pores 138 therein that communicate spaced pockets 140 between each of the ribs 128 with the cavity 124 formed between the surface 136 and the cover 134. The cover 134 has an open end 141 to direct flow into each of the pockets 140.

As oil initially flows inwardly through the regulating gap between the opposed surfaces 112 and 114 during the intermediate rotor thrust load phase of operation, oil flow from the outlet 90 will pass radially outwardly from shaft segment 16 into each of the individual pockets 140 from whence it is evenly distributed through the pores 138 in the cover 134 to be uniformly distributed into the cavity 124 between a radially outwardly directed annular space 142 thereof and the region of the cavity 124 between the cover 134 and the surface 136. As the oil is evenly distributed into these spaces, a centrifugally generated oil head is generated by the oil trapped between rotating piston 92 and counterpiston 64. The face of the piston 92 is roughened by pores 138 to cause the oil in cavity 124 to rotate with piston 92 to develope a dynamic head. The surface 136 is smooth to offer lesser drag to the rotating oil head which acts to the left as viewed in FIG. 1 to compensate the thrust loading on the rotor 12.

The cavity 124 will continue to fill in response to ever increasing thrust loads until the forward centrifugal force of the evenly distributed oil flow from the pores 134 into the cavity 124 will equal the rotor thrust force minus a force which is represented by the pre-bias of the Belleville spring 122. Consequently, the opposed surfaces 112, 114 will be balanced and will thereafter cycle opened and closed to maintain a constant depth of oil in the cavity 124.

If rotor thrust increases to the right, the regulator moves toward its open position to repeat the aforesaid cycle of oil flow into the cavity 124.

If centrifugal oil force increases on the rotary piston 92, the regulator moves to close the gap between the opposed surfaces 112, 114. In this case the rotor thrust bearing 32 only has a rearward thrust load of pounds thereon which is produced by the spring load of the Belleville spring 122.

In the arrangement illustrated in FIG. 1, a third operating mode is compensated which represents a maximum rearward rotor thrust on the rotor 12. During this mode of operation, substantial rotor thrust may act on rotor 12 to the right as shown in FIG. 1. Such rotor thrust imbalance can exceed the capacity of the variable axial load integrating device 34 and the rotor 12 will move to the right until a full 0.010 inches of travel occurs thereby to fully open the regulator and maintain a maximum gap between the facing surfaces 112, 114. Under such circumstances, the oil flow through the outlet 90 and to the individual pockets 140 is at a maximum and the outer annular space 142 and the portion of the cavity 124 between the cover 134 and the surface 136 of the counterpiston 64 will be uniformly filled to an overflowing point. The overflow of engine oil will be directed through spill holes 144 in the rotating piston 92 as best shown in FIGS. 1 and 2. This prevents oil flow in a rearward direction over the hub of the nonrotating counterpiston 64 and as a result there is no oil flooding of the cavity for the thrust bearing assembly 32.

The force of the Belleville spring 122 and that of the hydraulic force which is produced by the even flow of oil into the cavity 124 partially resists the rearward thrust on the rotor 12 and as a result the bearing carriage 58 will move to a full rearward position to engage a carriage snubber 146 located in a plane forwardly of the head of the stud 40. The thrust bearing assembly 32 will assume a force in the right direction of movement which is equal to the rotor thrust less the centrifugal oil force of the variable axial load integrating device 34. In such an arrangement, to produce full compensation of the rotor and balance, the diameter of the cavity 124 may be increased in some applications, however, in the illustrated arrangement the aforesaid system will minimize loads acting on the ball elements 66 of the bearing assembly 32 as compared to presently known devices.

While the embodiments of the present invention, as herein disclosed, constitutes a preferred form, it is to be understood that other forms might be adopted.

The embodiments of the invention in which an exclusive property or privilege is claimed are defined as follows:

1. A rotor thrust compensating assembly for association with a gas turbine engine comprising: a rotor axially movable in response to variable gas loads on a rotor element of a gas turbine engine, a thrust bearing having inner and outer races with anti-friction means therebetween, one of said races being fixed to said rotor for both axial and rotary movement therewith, bearing support means for the other of said races, variable axial load integrating means including a pair of relatively rotating pistons having a cavity therebetween, oil supply means for directing oil into said load integrating means in accordance with rotor thrust loads acting on the said one of said races, means on one of said relatively rotating pistons to define a plurality of separate circumferentially spaced pockets thereon, the other of said pair of relatively rotating pistons having an inboard surface, a cover on said one of said pistons with an open end thereon for directing oil from said oil supply means into each of said pockets, said cover having pores therethrough rotated with respect to said inboard surface for distributing liquid from said pockets to uniformly fill said cavity between said surface and said cover for producing a uniformly distributed resultant dynamic hydraulic force on said rotor to compensate variable gas loadings thereon.

2. A rotor thrust compensating assembly for association with a gas turbine engine comprising: a rotor extension having a fore segment and an aft segment and being axially movable in response to variable gas loads on a rotor element of a gas turbine engine, a thrust bearing having inner and outer races with anti-friction means therebetween, one of said races being fixed to said rotor extension for both axial and rotary movement therewith, bearing support means for the other of said races, variable axial load integrating means including a pair of relatively rotating pistons having a cavity therebetween, flow regulator means including said bearing support means to direct oil into said load integrating means in accordance with rotor thrust loads acting on the said one of said races, one of said relatively rotating pistons having a plurality of circumferentially spaced pockets thereon separated from one another by a plurality of reinforcing ribs to maintain a surface of said piston in spaced parallel relationship to an inboard surface of said other of said relatively rotating pistons, a cover for said pockets having an open end for directing oil into each of said pockets, said cover having pores therethrough rotated with respect to said inboard surface for distributing oil from each of said pockets to uniformly fill said cavity between said surface and said cover for producing a uniformly distributed resultant dynamic hydraulic force on said rotor extension to compensate variable gas loadings thereon.

* * * * *